US007576709B2

(12) United States Patent
Chung et al.

(10) Patent No.: US 7,576,709 B2
(45) Date of Patent: Aug. 18, 2009

(54) PLASMA DISPLAY PANEL DRIVING METHOD AND PLASMA DISPLAY DEVICE

(75) Inventors: Woo-Joon Chung, Suwon-si (KR); Jin-Sung Kim, Suwon-si (KR); Seung-Hun Chae, Suwon-si (KR); Kyoung-Ho Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 771 days.

(21) Appl. No.: 10/911,383

(22) Filed: Aug. 4, 2004

(65) Prior Publication Data

US 2005/0052356 A1 Mar. 10, 2005

(30) Foreign Application Priority Data

Aug. 5, 2003 (KR) ..... 10-2003-0054051

(51) Int. Cl.
*G09G 3/28* (2006.01)

(52) U.S. Cl. ..... 345/60; 345/63; 315/169.4

(58) Field of Classification Search ..... 345/60–72; 315/169.4; 313/581–585
See application file for complete search history.

(56) References Cited

U.S. PATENT DOCUMENTS 5,745,086 A 4/1998 Weber
6,294,875 B1 9/2001 Kurata et al.
6,317,105 B1 11/2001 Eo et al.
7,138,966 B2 * 11/2006 Shindo et al. ..... 345/63
2001/0017605 A1 8/2001 Hashimoto et al.
2002/0050960 A1 5/2002 Setoguchi et al.
2003/0090441 A1 5/2003 Kim et al.
2003/0156082 A1 8/2003 Seo et al.
2003/0222835 A1 * 12/2003 Yoon et al. ..... 345/60
2004/0085262 A1 5/2004 Lee
2005/0243027 A1 * 11/2005 Chung et al. ..... 345/60
2006/0087481 A1 * 4/2006 Kim et al. ..... 345/63

FOREIGN PATENT DOCUMENTS

CN 1333907 A 1/2002
CN 1348160 A 5/2002

(Continued)

OTHER PUBLICATIONS

Patent Abstracts of Japan for publication No. 08-030228, date of publication of Feb. 2, 1996, in the name of K. Ito et al.

(Continued)

*Primary Examiner*—Amare Mengistu
*Assistant Examiner*—Jennifer Zubajlo
(74) *Attorney, Agent, or Firm*—Christie Parker & Hale LLP

(57) ABSTRACT

A PDP driving method. No rising ramp voltage is applied to a scan electrode during a reset period. The final voltage of a falling ramp voltage is reduced to a voltage by which all the discharge cells can fire the discharge during the reset period. A difference between the voltage applied to the address electrode of the discharge cell to be selected and the voltage applied to the scan electrode is established to be greater than the maximum discharge firing voltage.

15 Claims, 6 Drawing Sheets

FOREIGN PATENT DOCUMENTS

| | | | |
|---|---|---|---|
| CN | 1352445 | A | 6/2002 |
| CN | 1355518 | A | 6/2002 |
| EP | 1 195 739 | A2 | 4/2002 |
| JP | 8-30228 | | 2/1996 |
| JP | 2000-305510 | A | 11/2000 |
| WO | WO 00/30065 | | 5/2000 |
| WO | WO 03/015068 | A1 | 2/2003 |

OTHER PUBLICATIONS

Patent Abstracts of Japan, Publication No. 2000-305510, dated Nov. 2, 2000, in the name of Koji Ito et al.

* cited by examiner

PLASMA DISPLAY PANEL DRIVING METHOD AND PLASMA DISPLAY DEVICE

CROSS REFERENCE TO RELATED APPLICATION

This application claims priority to and the benefit of Korea Patent Application No. 2003-54051 filed on Aug. 5, 2003 in the Korean Intellectual Property Office, the content of which is incorporated herein by reference.

BACKGROUND OF THE INVENTION (a) Field of the Invention

The present invention relates to a plasma display panel (PDP) driving method and a plasma display device.

(b) Description of the Related Art

A PDP is a flat display panel for showing characters or images using plasma generated by gas discharge. PDPs can include pixels numbering more than several million in a matrix format, in which the number of pixels are determined by the size of the PDP. Referring to FIGS. 1 and 2, a PDP structure will now be described.

FIG. 1 shows a partial perspective view of the PDP and FIG. 2 schematically shows an electrode arrangement of the PDP. As shown in FIG. 1, the PDP includes glass substrates 1, 6 facing each other with a predetermined gap therebetween. Scan electrodes 4 and sustain electrodes 5 in pairs are formed in parallel on glass substrate 1. Scan electrodes 4 and sustain electrodes 5 are covered with dielectric layer 2 and protection film 3. A plurality of address electrodes 8 is formed on glass substrate 6. Address electrodes 8 are covered with insulator layer 7. Barrier ribs 9 are formed on insulator layer 7 between address electrodes 8. Phosphors 10 are formed on the surface of insulator layer 7 and between barrier ribs 9. Glass substrates 1, 6 are provided facing each other with discharge spaces between glass substrates 1, 6 so that scan electrodes 4 and sustain electrodes 5 can cross address electrodes 8. Discharge space 11 between address electrode 8 and a crossing part of a pair of scan electrode 4 and sustain electrode 5 forms discharge cell 12, one of which is schematically indicated.

As shown in FIG. 2, the electrodes of the PDP have an n×m matrix format. Address electrodes $A_1$ to $A_m$ are arranged in the column direction, and n scan electrodes $Y_1$ to $Y_n$ and n sustain electrodes $X_1$ to $X_n$ are arranged in the row direction.

U.S. Pat. No. 6,294,875 by Kurata for driving a PDP discloses a method for dividing one field into eight subfields and applying different waveforms in the reset period of the first subfield and the second to eighth subfields.

As shown in FIG. 3, a subfield includes a reset period, an address period, and a sustain period. A ramp waveform which gradually rises from voltage $V_p$ of less than a discharge firing voltage to voltage $V_r$ that is greater than the discharge firing voltage is applied to scan electrodes $Y_1$ to $Y_n$ during the reset period of the first subfield. Weak discharges are generated to address electrodes $A_1$ to $A_m$ and sustain electrodes $X_1$ to $X_n$ from scan electrodes $Y_1$ to $Y_n$ while the ramp waveform rises. Negative wall charges are accumulated to scan electrodes $Y_1$ to $Y_n$, and positive wall charges are accumulated to address electrodes $A_1$ to $A_m$ and sustain electrodes $X_1$ to $X_n$ because of the discharges. The wall charges are actually formed on protection film 3 on scan electrodes 4 and sustain electrodes 5 in FIG. 1, but the wall charges are described as being generated on scan electrodes 4 and sustain electrodes 5 below for ease of description.

A ramp voltage which gradually falls from voltage $V_q$ of less than the discharge firing voltage to voltage 0V (volts) is applied to scan electrodes $Y_1$ to $Y_n$. A weak discharge is generated on scan electrodes $Y_1$ to $Y_n$ from sustain electrodes $X_1$ to $X_n$ and address electrodes $A_1$ to $A_m$ by a wall voltage formed at the discharge cells while the ramp voltage falls. Part of the wall charges formed on sustain electrodes $X_1$ to $X_n$, scan electrodes $Y_1$ to $Y_n$, and address electrodes $A_1$ to $A_m$ are erased by the discharge, and they are established to be appropriate for addressing. In a like manner, the wall charges are actually formed on the surface of insulator layer 7 of address electrode 8 in FIG. 1, but they are described as being formed on address electrode 8 for ease of description.

Next, when positive voltage $V_w$ is applied to address electrodes $A_1$ to $A_m$ of the discharge cells to be selected, and 0V is applied to scan electrodes $Y_1$ to $Y_n$ in the address period, address discharging is generated between address electrodes $A_1$ to $A_m$ and scan electrodes $Y_1$ to $Y_n$ and between sustain electrodes $X_1$ to $X_n$ and scan electrodes $Y_1$ to $Y_n$ by the wall voltage caused by the wall charges formed during the reset period and positive voltage $V_w$. By the address discharging, positive wall charges are accumulated on scan electrodes $Y_1$ to $Y_n$, and negative wall charges are accumulated on sustain electrodes $X_1$ to $X_n$ and address electrodes $A_1$ to $A_m$. Sustain discharging is generated on the discharge cells on which the wall charges are accumulated by the address discharging, by a sustain pulse applied during the sustain period.

A voltage level of the last sustain pulse applied to scan electrodes $Y_1$ to $Y_n$ during the sustain period of the first subfield corresponds to voltage $V_r$ of the reset period, and voltage ($V_r$–$V_s$) corresponding to a difference between voltage $V_r$ and sustain voltage $V_s$ is applied to sustain electrodes $X_1$ to $X_n$. A discharge is generated from scan electrodes $Y_1$ to $Y_n$ to address electrodes $A_1$ to $A_m$ because of the wall voltage formed by the address discharging, and sustain discharging is generated from scan electrodes $Y_1$ to $Y_n$ to sustain electrodes $X_1$ to $X_n$ in the discharge cells selected in the address period. The discharges correspond to the discharges generated by the rising ramp voltage in the reset period of the first subfield. No discharge occurs in the discharge cells which are not selected since no address discharging is provided in the discharge cells.

In the reset period of the second following subfield, voltage $V_h$ is applied to sustain electrodes $X_1$ to $X_n$, and a ramp voltage which gradually falls from voltage $V_q$ to 0V is applied to scan electrodes $Y_1$ to $Y_n$. That is, the voltage which corresponds to the falling ramp voltage applied during the reset period of the first subfield is applied to scan electrodes $Y_1$ to $Y_n$. A weak discharge is generated on the discharge cells selected in the first subfield, and no discharge is generated on the discharge cells that are not selected.

In the reset period of the last following subfield, the same waveform as that of the reset period of the second subfield is applied. An erase period is formed after the sustain period in the eighth subfield. A ramp voltage which gradually rises from 0V to voltage $V_e$ is applied to sustain electrodes $X_1$ to $X_n$ during the erase period. The wall charges formed in the discharge cells are erased by the ramp voltage.

As to the above-described conventional driving waveforms, discharges are generated on all the discharge cells by the rising ramp voltage in the reset period of the first subfield, and accordingly, the discharges problematically occur in the cells which are not to be displayed, thereby worsening the contrast ratio. Further, since the addressing is sequentially performed on all the scan electrodes in the address period of using an internal wall voltage, the internal wall voltage of the scan electrodes that are selected in the later stage is lost. The lost wall voltage reduces margins as a result.

SUMMARY OF THE INVENTION

In accordance with the present invention a PDP driving method is provided for performing addressing without using an internal wall voltage.

In accordance with the present invention, the wall voltage is rarely used for the addressing.

In one aspect of the present invention, a method for driving a PDP having a plurality of first and second electrodes formed in parallel on a first substrate, and a plurality of address electrodes which cross the first and second electrodes and are formed on a second substrate, wherein the adjacent first electrode, the second electrode, and the address electrode form a discharge cell, includes: gradually reducing a voltage generated by subtracting a voltage at the address electrode from a voltage at the first electrode to a second voltage from a first voltage, during a reset period; respectively applying a third voltage and a fourth voltage to the first electrode and the address electrode of the discharge cell to be selected from among the discharge cells, during an address period; and sustain discharging the discharge cell selected in the address period, during a sustain period, wherein the second voltage is substantially less than a negative value of half of the voltage applied to the first and second electrodes for the sustain discharging in the sustain period.

The second voltage substantially is less than a negative value of 80% of a voltage difference between the first and second electrodes for the sustain discharging in the sustain period.

The second voltage is substantially greater than a discharge firing voltage between the first electrode and the address electrode. The discharge firing voltage fires a discharge when substantially no wall charges are formed in the discharge cell. A wall voltage between the first electrode and the address electrode is substantially eliminated during the reset period. The discharge firing voltage is the greatest one from among the discharge firing voltages of the discharge cell in a valid display region.

A difference of the third and fourth voltages is greater than the discharge firing voltage.

In another aspect of the present invention, a plasma display includes: a first substrate; a plurality of first electrodes and second electrodes formed in parallel on the first substrate; a second substrate facing the first substrate with a gap therebetween; a plurality of third electrodes crossing the first and second electrodes and being formed on the second substrate; and a driving circuit for supplying a driving voltage to the first, second, and third electrodes so as to discharge the discharge cells formed by the adjacent first, second, and third electrodes. The driving circuit gradually reduces a voltage generated by subtracting a voltage at the third electrode from a voltage at the first electrode to a first voltage during a reset period, discharges a discharge cell to be selected from among the discharge cells during an address period, and sustain-discharges the selected discharge cell during a sustain period. The first voltage is substantially less than a negative value of half of the voltage applied to the first and second electrodes for the sustain discharging in the sustain period.

In still another aspect of the present invention, a method is provided for driving a PDP which has a plurality of first and second electrodes formed in parallel on a first substrate, and a plurality of third electrodes which cross the first and second electrodes and are formed on a second substrate. The adjacent first electrode, the second electrode, and the third electrode form a discharge cell. A field is divided into a plurality of subfields and then driven, each subfield includes a reset period, an address period, and a sustain period. All subfields respectively form at least one field. The method includes: gradually reducing a voltage at the first electrode to a second voltage from a first voltage during the reset period; respectively applying a third voltage and a fourth voltage to the first electrode and the third electrode of the discharge cell to be selected from among the discharge cells, during the address period; and sustain discharging the discharge cell selected in the address period, during the sustain period, wherein the voltage at the first electrode falls to the first voltage after the last pulse of the sustain period of the previous subfield.

In still yet another aspect of the present invention, a method is provided for driving a PDP which has a plurality of first and second electrodes formed in parallel on a first substrate, and a plurality of address electrodes which cross the first and second electrodes and are formed on a second substrate. An adjacent first electrode, second electrode, and address electrode form a discharge cell. The method includes: sequentially applying a first voltage to the first electrodes, and applying a second voltage to the address electrode while the first voltage is applied to the first electrode of the discharge cell to be selected from among the discharge cells, wherein the first voltage is substantially less than a negative value of half of the difference of voltages applied to the first and second electrodes for sustain discharge in the sustain period.

DETAILED DESCRIPTION

Figure 4:
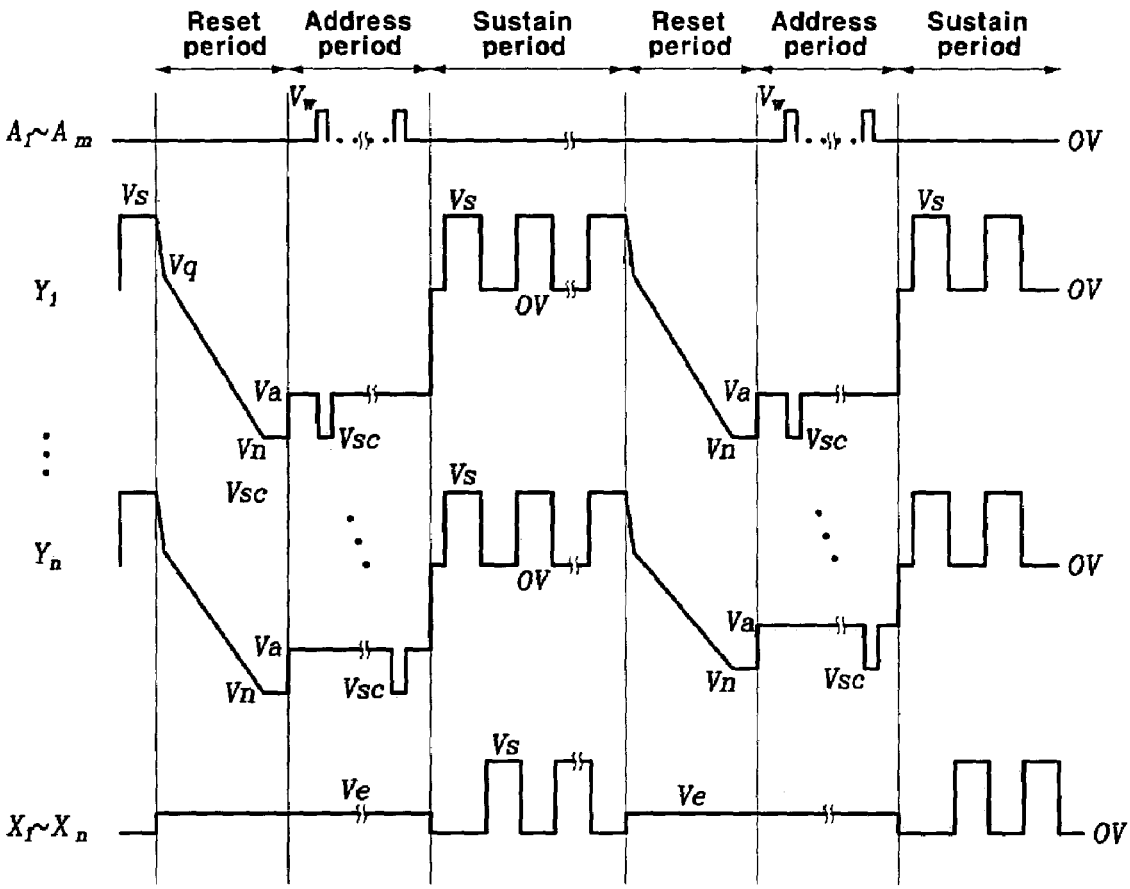
FIGS. 4, 6, and 7 show PDP driving waveform diagrams according to first to third exemplary embodiments of the present invention.

Referring now to FIG. 4, a PDP driving method according to a first exemplary embodiment of the present invention will be described. Notations of reference numerals as address electrodes $A_1$ to $A_m$, scan electrodes $Y_1$ to $Y_n$, and sustain electrodes $X_1$ to $X_n$ represent that the same voltage is applied to the address electrodes, the scan electrodes, and the sustain electrodes, and notations of reference numerals as address electrodes $A_i$ and scan electrodes $Y_j$ represent that a corresponding voltage is applied to some of the address electrodes and the scan electrodes.

FIG. 4 shows a PDP driving waveform diagram according to a first exemplary embodiment of the present invention. As shown, the driving waveform includes a reset period, an address period, and a sustain period. The PDP is coupled to a scan/sustain driving circuit for applying a driving voltage to scan electrodes $Y_1$ to $Y_n$ and sustain electrodes $X_1$ to $X_n$ and an address driving circuit (not illustrated) for applying a driving voltage to address electrodes $A_1$ to $A_m$ in each period. The driving circuits and the PDP coupled thereto configure a plasma display.

The wall charges formed in the sustain period are eliminated in the reset period, discharge cells to be displayed are selected from among the discharge cells in the address period, and the discharge cells selected in the address period are discharged in the sustain period.

In the sustain period, sustain discharging is performed by a difference between the wall voltage caused by the wall charges formed in the discharge cells selected in the address period and the voltage formed by the sustain pulse applied to the scan electrode and the sustain electrode. Voltage $V_s$ is applied to scan electrodes $Y_1$ to $Y_n$ at the last sustain pulse in the sustain period, and a reference voltage (assumed as 0V in FIG. 4) is applied to sustain electrodes $X_1$ to $X_n$. The selected discharge cell is discharged between scan electrode $Y_j$ and sustain electrode $X_j$, and negative and positive wall charges are respectively formed on scan electrode $Y_j$ and sustain electrode $X_j$.

In the reset period, a ramp voltage which gradually falls from voltage $V_q$ to voltage $V_n$ is applied to scan electrodes $Y_1$ to $Y_n$ after the last sustain pulse is applied in the sustain period, and reference voltage 0V is applied to address electrodes $A_1$ to $A_m$, and sustain electrodes $X_1$ to $X_n$ are biased with voltage $V_e$. When the discharge firing voltage between the address electrode and the scan electrode in the discharge cell is set to be voltage $V_{fay}$, last voltage $V_n$ of the falling ramp voltage corresponds to voltage $-V_{fay}$.

In general, when the voltage between the scan electrode and the address electrode or between the scan electrode and the sustain electrode is greater than the discharge firing voltage, a discharge occurs between the scan electrode and the address electrode or between the scan electrode and the sustain electrode. In particular, when the gradually falling ramp voltage is applied to generate discharges as described in the first exemplary embodiment, the wall voltage in the discharge cell is reduced by the same gradient as that the of falling ramp voltage. Because this principle is disclosed in detail in U.S. Pat. No. 5,745,086, no corresponding descriptions will be provided.

Figure 5:
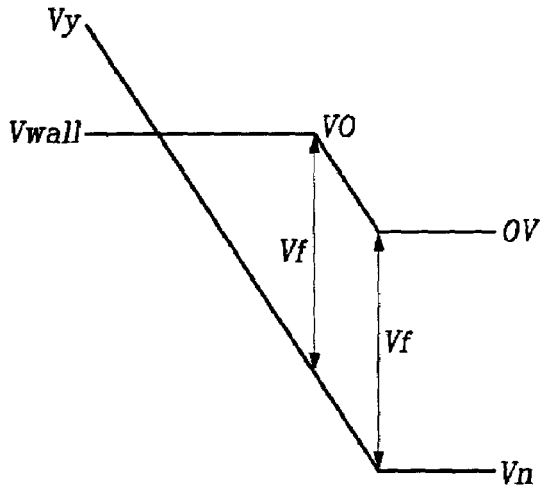
FIG. 5 shows a relational diagram between a falling ramp voltage and a wall voltage when the falling ramp voltage is applied to the discharge cells.

Referring to FIG. 5, a discharge characteristic when the ramp voltage falling to voltage $-V_{fay}$ is applied will be described. FIG. 5 shows a relational diagram between a falling ramp voltage and a wall voltage when the falling ramp voltage is applied to the discharge cells. Scan electrodes and address electrodes will be described in FIG. 5 assuming that a predetermined wall voltage $V_o$ is formed since negative and positive charges are respectively accumulated on the scan and address electrodes before the falling ramp voltage is applied. As shown, when the difference between wall voltage $V_{wall}$ and voltage $V_y$ applied to the scan electrode becomes greater than discharge firing voltage $V_{fay}$ while the voltage applied to the scan electrode is gradually reduced, a discharge is generated, and wall voltage $V_{wall}$ in the discharge cell is reduced by the same gradient as that of falling ramp voltage $V_y$. In this instance, the difference between falling ramp voltage $V_y$ and wall voltage $V_{wall}$ maintains discharge firing voltage $V_{fay}$. Accordingly, wall voltage $V_{wall}$ between the address electrode and the scan electrode within the discharge cell reaches 0V when voltage $V_y$ applied to the scan electrode is reduced to voltage $-V_{fay}$.

Since the discharge firing voltage is varied according to characteristics of the discharge cells, voltage $V_y$ applied to the scan electrode is to allow all the discharge cells to be discharged from address electrodes $A_1$ to $A_m$ to scan electrodes $Y_1$ to $Y_n$. All the discharge cells include discharge cells which are provided at an area that can influence displaying a screen on the PDP.

That is, as given in Equation 1, difference $V_{A\text{-}Y,reset}$ between voltage 0V applied to address electrodes $A_1$ to $A_m$ and voltage $V_n$ applied to scan electrodes $Y_1$ to $Y_n$ is established to be greater than maximum discharge firing voltage $V_{f,MAX}$ of the discharge cell which has the greatest discharge firing voltage from among the discharge cells which have the discharge firing voltages of $V_{fay}$. In this instance, it is desirable for the size $|V_n|$ of voltage $V_n$ to correspond to maximum discharge firing voltage $V_{f,MAX}$ since a negative wall voltage is formed when size $|V_n|$ of voltage $V_n$ is far greater than maximum discharge firing voltage $V_{f,MAX}$.

$$V_{A\text{-}Y,reset}=|V_n|\geqq V_{f,MAX} \quad \text{Equation 1}$$

As described, the wall voltage is eliminated from all the discharge cells when a ramp voltage which falls to voltage $V_n$ is applied to scan electrodes $Y_1$ to $Y_n$. A negative wall voltage can be generated in the discharge cells having discharge firing voltage $V_f$ of less than maximum discharge firing voltage $V_{f,MAX}$ when the size $|V_n|$ of voltage $V_n$ is set to be maximum discharge firing voltage $V_{f,MAX}$. That is, the negative wall charges are generated on address electrodes $A_1$ to $A_m$ and scan electrodes $Y_1$ to $Y_n$. The generated wall voltage in this instance is a voltage for solving non-uniformity between the discharge cells in the address period.

In the address period, the voltages at scan electrodes $Y_1$ to $Y_n$ and sustain electrodes $X_1$ to $X_n$ are maintained at reference voltage 0V and voltage $V_e$ respectively, and voltages are applied to scan electrodes $Y_1$ to $Y_n$ and address electrodes $A_1$ to $A_m$ so as to select discharge cells to be displayed. That is, negative voltage $V_{sc}$ is applied to scan electrode $Y_1$ of the first row, and positive voltage $V_w$ is applied to address electrode $A_1$ which is concurrently provided on the discharge cell to be displayed in the first row. Voltage $V_{sc}$ corresponds to voltage of $V_n$ in FIG. 4.

Accordingly, as given in Equation 2, voltage difference $V_{A\text{-}Y,address}$ between address electrode $A_i$ and scan electrode $Y_1$ in the discharge cell selected in the address period always becomes greater than maximum discharge firing voltage $V_{f,MAX}$.

$$V_{A\text{-}Y,address}=V_{A\text{-}Y,reset}+V_w\geqq V_{f,MAX} \quad \text{Equation 2}$$

Therefore, addressing is generated between address electrode $A_i$ and scan electrode $Y_1$ and between sustain electrode $X_1$ and scan electrode $Y_1$ in the discharge cell formed by address electrode $A_i$ to which voltage of $V_w$ is applied and scan electrode $Y_1$ to which voltage of $V_{sc}$ is applied. As a result, positive wall charges are formed on scan electrode $Y_1$ and negative wall charges are formed on sustain electrode $X_1$ and address electrode $A_i$.

Next, voltage $V_{sc}$ is applied to scan electrode $Y_2$ in the second row, and voltage $V_w$ is applied to address electrode $A_i$ provided on the discharge cell to be displayed in the second row. As a result, addressing is generated in the discharge cell formed by address electrode $A_i$ to which voltage $V_w$ is applied and scan electrode $Y_1$ to which voltage $V_{sc}$ is applied, and hence, the wall charges are formed in the discharge cell. In a like manner, voltage $V_{sc}$ is sequentially applied to scan electrodes $Y_3$ to $Y_n$ in the residual rows, and voltage $V_w$ is applied to the address electrodes provided on the discharge cells to be displayed, thereby forming the wall charges.

In the sustain period, voltage $V_s$ is applied to scan electrodes $Y_1$ to $Y_n$ and reference voltage 0V is applied to sustain electrodes $X_1$ to $X_n$. The voltage between scan electrode $Y_j$ and sustain electrode $X_j$ exceeds discharge firing voltage $V_{fxy}$ between the scan electrode and the sustain electrode in the discharge cell selected in the address period since the wall voltage caused by the positive wall charges of scan electrode $Y_j$ and the negative wall charges of sustain electrode $X_j$ formed in the address period is added to voltage $V_s$. Therefore, sustain discharging is generated between scan electrode $Y_j$ and sustain electrode $X_j$. Negative and positive wall charges are respectively formed on scan electrode $Y_j$ and sustain electrode $X_j$ of the discharge cell on which the sustain discharging is generated.

Next, 0V is applied to scan electrodes $Y_1$ to $Y_n$ and voltage $V_s$ is applied to sustain electrodes $X_1$ to $X_n$. In the previous discharge cell in which the sustain discharging is generated, the voltage between sustain electrode $X_j$ and scan electrode $Y_j$ exceeds discharge firing voltage $V_{fxy}$ between the scan electrode and the sustain electrode since the wall voltage caused by the positive wall charges of sustain electrode $X_j$ and the negative wall charges of scan electrode $Y_j$ formed in the previous sustain discharging is added to voltage $V_s$. Therefore, the sustain discharging is generated between scan electrode $Y_j$ and sustain electrode $X_j$, and the positive and negative wall charges are respectively formed on scan electrode $Y_j$ and sustain electrode $X_j$ of the discharge cell in which the sustain discharging is generated.

In the like manner, voltage $V_s$ and 0V are alternately applied to scan electrodes $Y_1$ to $Y_n$ and sustain electrodes $X_1$ to $X_n$ to maintain the sustain discharging. As described, the last sustain discharging is generated while voltage $V_s$ is applied to scan electrodes $Y_1$ to $Y_n$ and 0V is applied to sustain electrodes $X_1$ to $X_n$. A subfield which starts from the above-noted reset period is provided after the last sustain discharging.

Figure 1:
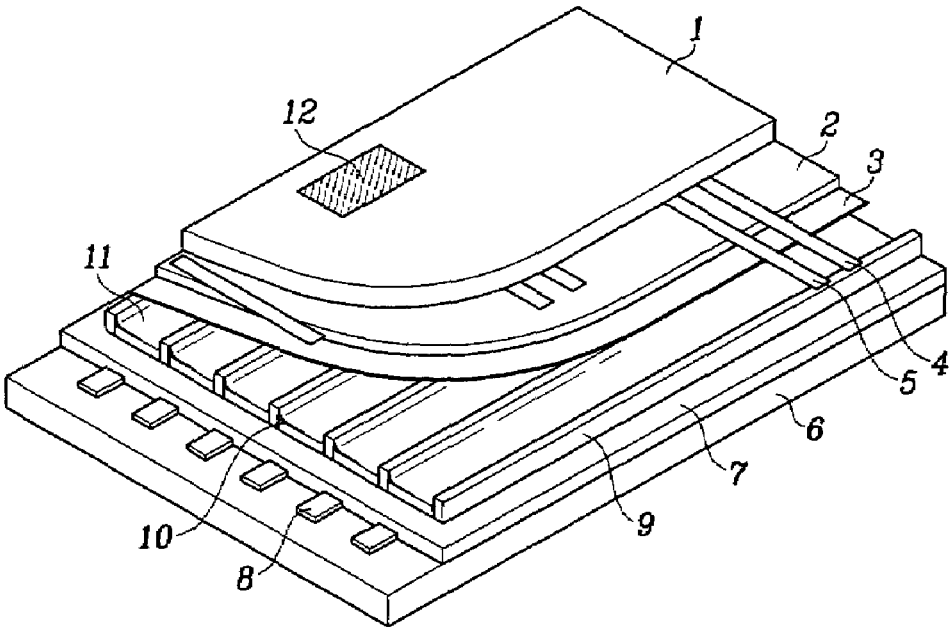
FIG.1 (Prior Art)
FIG. 1 shows a brief perspective view of a general PDP.
Figure 2:
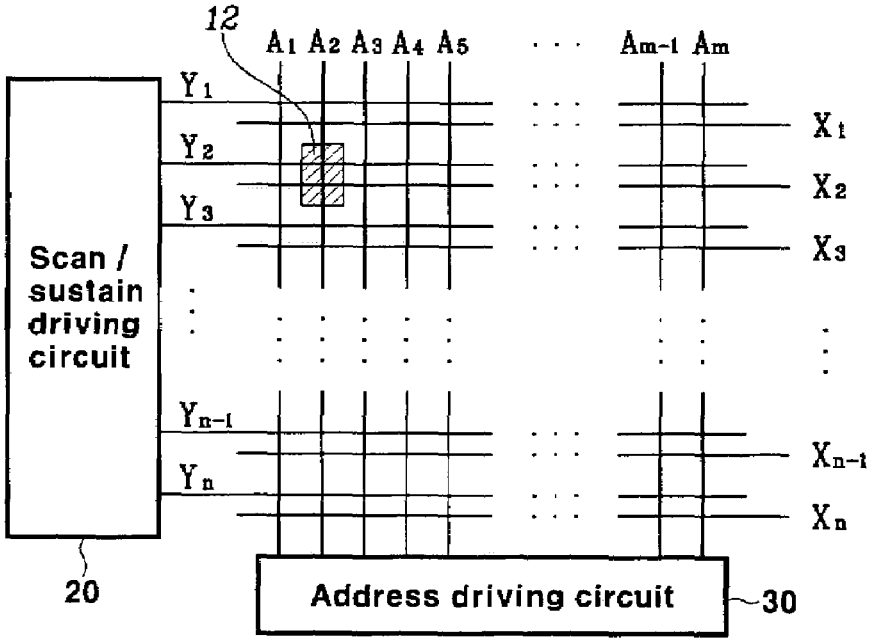
FIG.2 (Prior Art)
FIG. 2 shows an electrode arrangement diagram of a general PDP.
Figure 3:
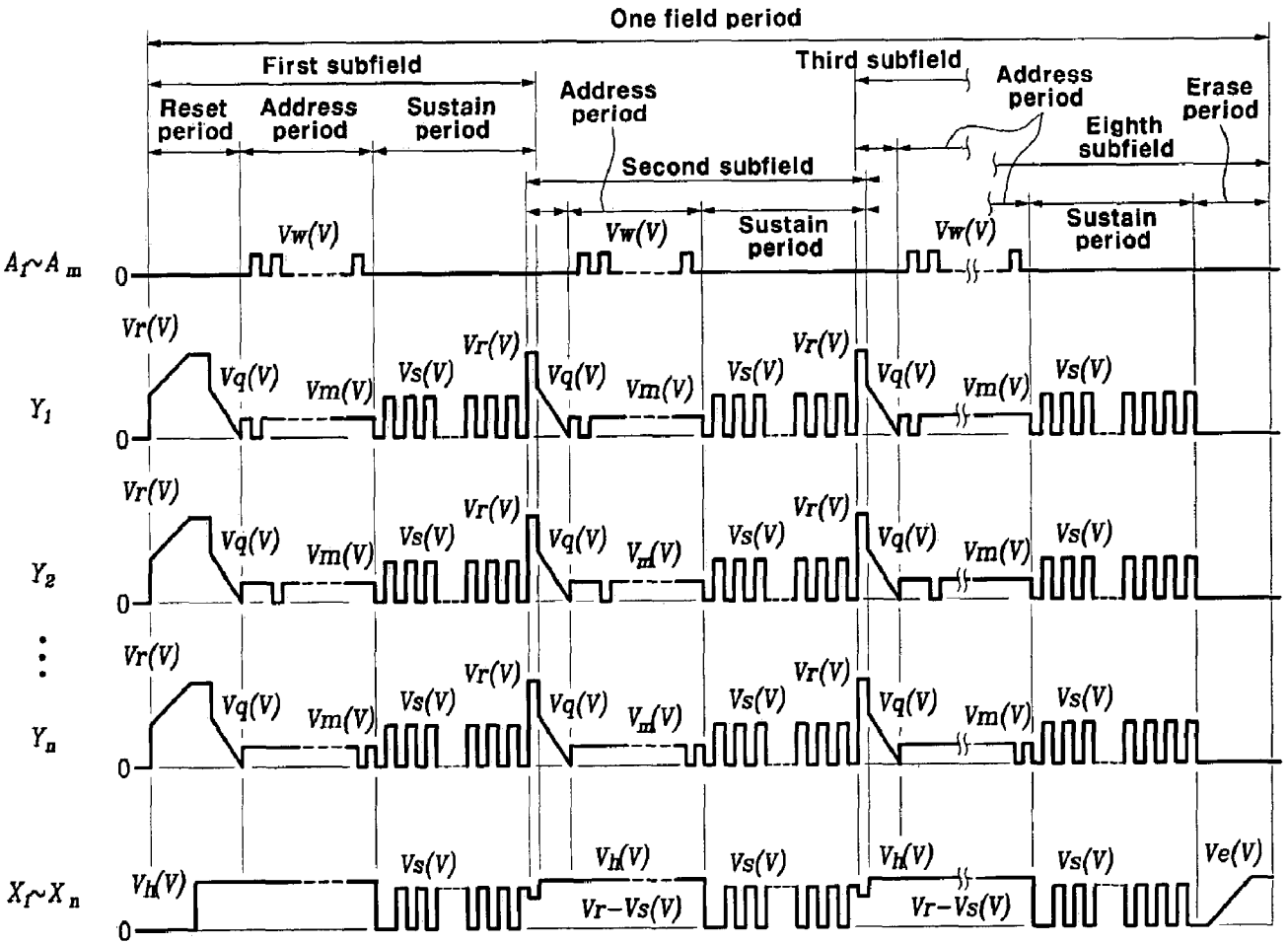
FIG.3 (Prior Art)
FIG. 3 shows a conventional PDP driving waveform diagram.

In the first exemplary embodiment, the addressing is generated when no wall charges are formed in the reset period, by allowing the voltage difference between the address electrode and the scan electrode of the discharge cell to be displayed in the address period to be greater than the maximum discharge firing voltage. Hence, the problem of worsening the margins is removed since the addressing is not influenced by the wall charges formed in the reset period. The amount of discharging is reduced in the reset period compared to the prior art since no wall charges are used in the addressing, and there is no need to form the wall charges by using the rising ramp voltage in the reset period in the same manner of the prior art. Therefore, the contrast ratio is improved since the amount of discharges by the reset period is reduced in the discharge cells which do not emit light. Further, the maximum voltage applied to the PDP is lowered since voltage $V_r$ is eliminated of FIG. 1.

The circuit for driving the scan electrodes is simplified since voltages $V_{sc}$, $V_n$ can be supplied by the same power by making voltages of $V_{sc}$, $V_n$ correspond to each other. In addition, the addressing is generated irrespective of the wall charges since the voltage difference between the address electrode and the scan electrode in the selected discharge cell can be greater than the maximum discharge firing voltage by greater than voltage $V_w$.

In the first exemplary embodiment, the reference voltage is established to be 0V, and it can further be set to be other voltages. When it is possible to allow the difference between voltages $V_w$, $V_{sc}$ to be greater than the maximum discharge firing voltage, voltage $V_{sc}$ can be different from voltage $V_n$.

Next, relationships of discharge firing voltage $V_{fay}$ between the address electrode and the scan electrode, discharge firing voltage $V_{fxy}$ between the sustain electrode and the scan electrode, and voltage $V_s$ in the first exemplary embodiment will be described. The discharge of the PDP is determined by the amount of secondary electrons generated when the positive ions are collided with the cathode, referred to as a γ process. Accordingly, the discharge firing voltage of when the electrode covered with matter of a high secondary electron emission coefficient γ is operated as the cathode is less than the discharge firing voltage of when the electrode covered with matter of a low secondary electron emission coefficient γ. In a 3-electrode PDP, the address electrode formed on the rear substrate is covered with a phosphor for representation of colors, and the scan electrode and the sustain electrode formed on the front substrate is covered with a film which has a high secondary electron emission coefficient such as MgO. Since the scan electrode and the sustain electrode are symmetrically formed and the address electrode and the scan electrode are asymmetrically formed, the discharge firing voltage between the address electrode and the scan electrode is varied depending on the case in which the address electrode is operated as an anode and the case in which the address electrode is operated as a cathode.

That is, discharge firing voltage $V_{fay}$ of when the address electrode covered with a phosphor is operated as an anode and the scan electrode covered with a dielectric layer is operated as a cathode is less than discharge firing voltage $V_{fya}$ of when the address electrode is operated as a cathode and the scan electrode is operated as an anode. The relation of discharge firing voltage $V_{fay}$ of when the address electrode is an anode, discharge firing voltage $V_{fya}$ of when the address electrode is a cathode, and discharge firing voltage $V_{fxy}$ of between the scan electrode and the sustain electrode satisfies Equation 3. The relation is variable according to states of the discharge cells.

$$V_{fay}+V_{fya}=2V_{fxy} \quad \text{Equation 3}$$

Since the scan electrode is operated as a cathode in the reset period and the address period, discharge firing voltage $V_{fay}$ of between the address electrode and the scan electrode is given as Equation 4 from Equation 3. Since no sustain discharge is to be generated in the discharge cells which are not addressed in the address period, voltage $V_s$ is less than discharge firing voltage $V_{fxy}$ of between the scan electrode and the sustain electrode as expressed in Equation 5.

$$V_{fay}\langle V_{fxy} \quad \text{Equation 4}$$

$$V_s\langle V_{fxy} \quad \text{Equation 5}$$

Since the wall voltage between the address electrode and the scan electrode is established to be near 0V during the reset period in the first embodiment, no consecutive discharge is to be generated between the scan electrode and the address electrode and between the sustain electrode and the address electrode during the sustain period in the discharge cells which are not addressed during the address period. In detail, the case of consecutive generation of discharge includes a case in which a discharge is generated between the scan electrode and the address electrode by applying voltage $V_s$ to the scan electrode to generate, and a discharge is generated between the sustain electrode and the address electrode when voltage $V_s$ is applied to the sustain electrode after the positive wall charges are formed on the address electrode because of the discharge generated between the scan electrode and the address electrode. Since sustain electrode and the scan electrode are symmetric, the discharge firing voltage between the sustain electrode and the address electrode corresponds to voltage $V_{fay}$, and the wall voltage formed on the sustain electrode and the address electrode when the positive wall charges are accumulated on the sustain electrode by the discharge of the scan electrode and the address electrode is not established to exceed voltage $V_{fay}$. Therefore, voltage $V_{fay}$ is to be greater than voltage $V_s/2$ as given in Equation 6 so that no discharge may occur when voltage $V_s$ is applied after the positive wall charges are formed on the sustain electrode according to the discharge between the scan electrode and the address electrode.

Equation 6

$$V_s - V_{fay} < V_{fay}$$

$$V_{fay} > V_s/2$$

From Equations 4 to 6, voltage $V_{fay}$ is determined near voltage $V_s$ since voltage $V_{fay}$ is established to be greater than voltage $V_s/2$ and voltages $V_{fay}$, $V_s$ are to be less than voltage $V_{fxy}$ by greater than a predetermined voltage.

Figure 8A:
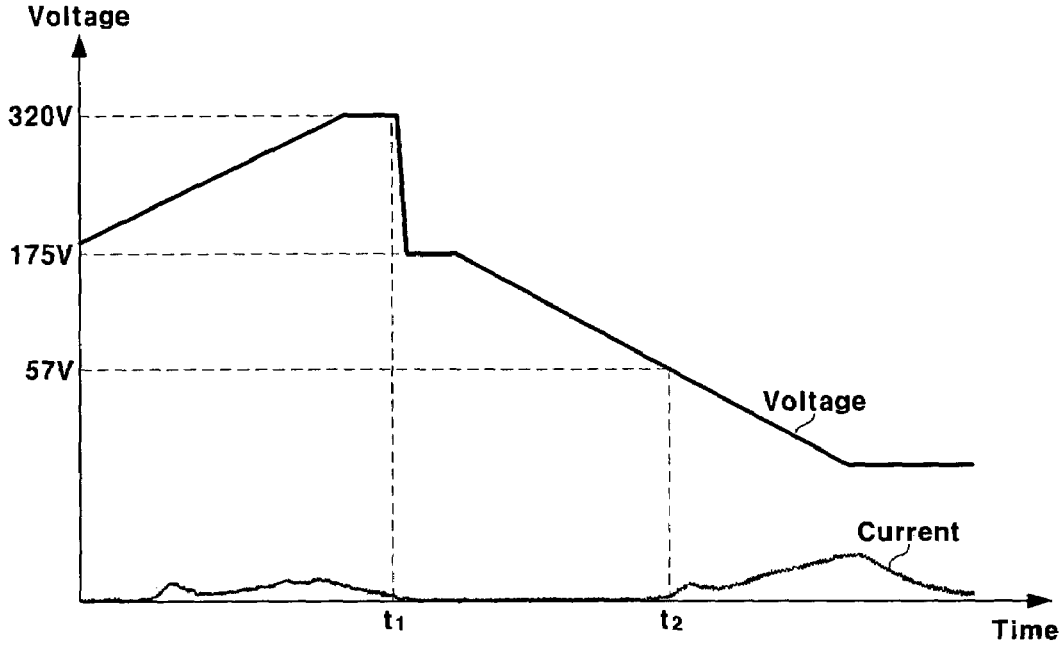
FIG. 8A shows a voltage applied diagram for measuring the discharge firing voltage.
Figure 8B:
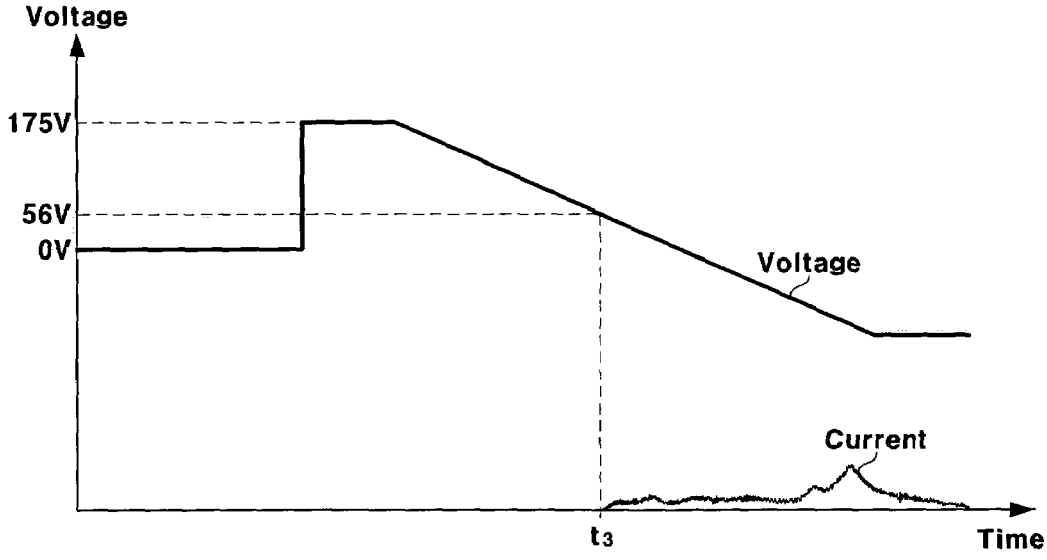
FIG. 8B shows discharged states in the sustain period and the reset period.

FIG. 8A shows a voltage applied diagram for measuring the discharge firing voltage, and FIG. 8B shows discharged states in the sustain period and the reset period. The voltages at the sustain electrode and the address electrode are not illustrated, the discharge current at the time when the falling ramp voltage is applied to the scan electrode is only illustrated in FIG. 8B. When 0V is applied to the sustain electrode and the scan electrode at the finished time of the sustain period, a self erase discharge can be generated between the address electrode and the scan electrode because of the wall voltage formed between the address electrode and the scan electrode. Hence, wall voltage $V_{way}$ formed between the address electrode and the scan electrode in the sustain period is needed to be established less than the discharge firing voltage $V_{fay}$ between the address electrode and the scan electrode as given in Equation 7. In this instance, since the positive wall charges are formed on the address electrode and the negative wall charges are formed on the scan electrode, the discharge firing voltage is discharge firing voltage $V_{fay}$ when the address electrode is an anode.

$$V_{way} < V_{fay} \qquad \text{Equation 7}$$

In general, the wall charges which are able to maintain the voltage which is half the voltage between the scan electrode and the sustain electrode are formed on the address electrode in the sustain period. Therefore, wall voltage $V_{way}$ between the scan electrode and the address electrode when voltage $V_s$ is applied to the scan electrode and 0V is applied to the sustain electrode and the address electrode is given in Equation 8.

$$V_{way} = (V_{wxy} + V_s)/2 \qquad \text{Equation 8}$$

The voltage between the scan electrode and the sustain electrode (a summation of an externally applied voltage and the wall voltage) is maintained at the discharge firing voltage state when the voltage at the scan electrode is gently varied as described above. As shown in FIG. 8A, when the voltage at the scan electrode is gradually increased while the voltage (not shown) at the sustain electrode is fixed to be 0V, a weak discharge is generated between the scan electrode and the sustain electrode, and wall charges are formed between the scan electrode and the sustain electrode. As the voltage at the scan electrode is increased, wall charges are formed so that the voltage between the scan electrode and the sustain electrode may be maintained at the discharge firing voltage. When the voltage at the scan electrode is increased to reach the final voltage of 320V and the wall voltage is formed between the scan electrode and the sustain electrode, the voltage (not shown) at the sustain electrode is fixed to be 165V, and the voltage at the scan electrode is gradually decreased. In this instance, the time at which a weak discharge is generated again between the scan electrode and the sustain electrode is a time at which the varied voltage between the scan electrode and the sustain electrode is double the discharge firing voltage. Accordingly, since the discharge is generated when the voltage at the scan electrode is 57V referring to FIG. 8A, it is assumed that double the discharge firing voltage is 428V which is the summation of 320V and (165−57)V. That is, discharge firing voltage $V_{fxy}$ between the scan electrode and the sustain electrode is approximately 214V.

Referring to FIG. 8B, voltage $V_s$ (=175V) is applied to the scan electrode in the final part of the sustain period to generate a final sustain discharge, wall voltage $V_{wxy}$ is formed between the sustain electrode and the sustain electrode, and the voltage at the scan electrode is gradually decreased while the voltage (not shown) at the sustain electrode is fixed to be 165V. In this instance, it is known that a weak discharge is generated between the scan electrode and the sustain electrode when the voltage at the scan electrode approximately reaches 56V, which is the case in which the summation of the voltages applied to the scan electrode and the sustain electrode and the wall voltage formed between the scan electrode and the sustain electrode becomes discharge firing voltage $V_{fxy}$. Therefore, it is known from Equation 9 that wall voltage $V_{wxy}$ formed between the scan electrode and the sustain electrode in the sustain period is approximately 105V, that is, about 60% of voltage $V_s$.

$$V_{fxy}(214\text{V}) = (165-56)\text{V} + V_{wxy} \qquad \text{Equation 9}$$

Since wall voltage $V_{wxy}$ formed in the sustain period is 60% of voltage $V_s$, wall voltage $V_{way}$ formed between the scan electrode and the address electrode in the sustain period corresponds to 80% of voltage $V_s$ from Equation 8. Therefore, it is known from Equation 7 that discharge firing voltage $V_{fay}$ between the scan electrode and the address electrode is greater than $0.8V_s$.

Figure 6:
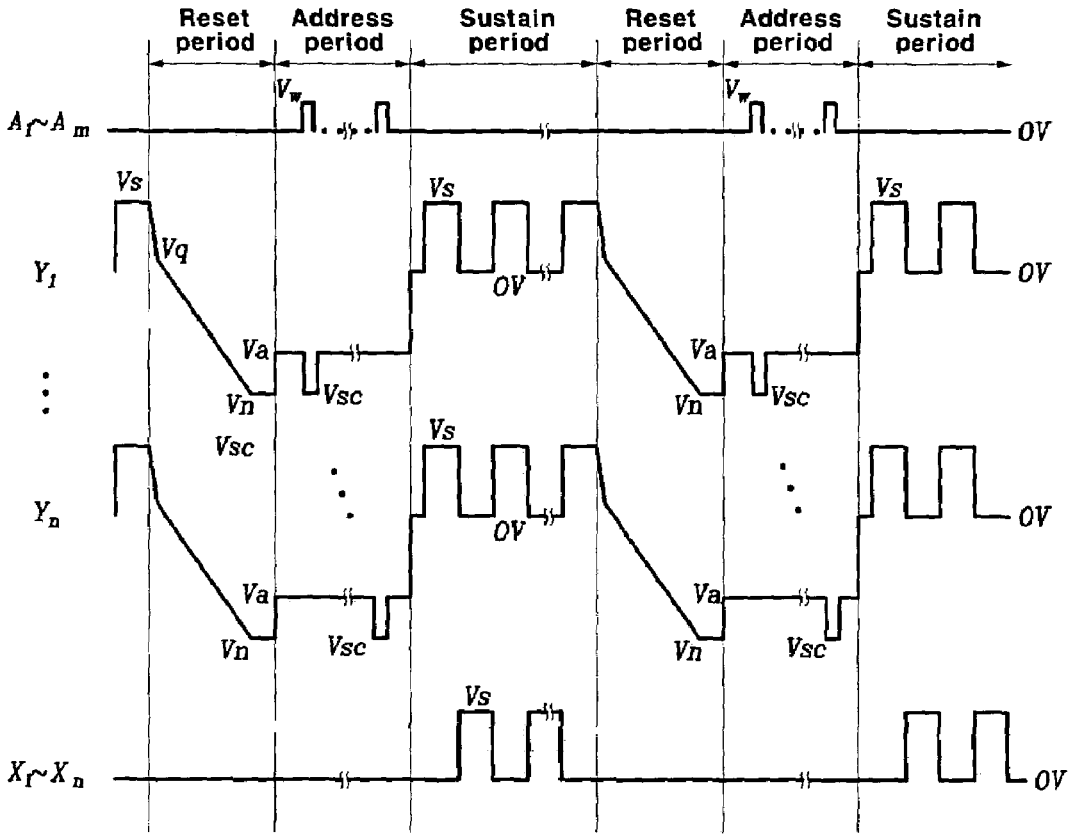
Figure 7:
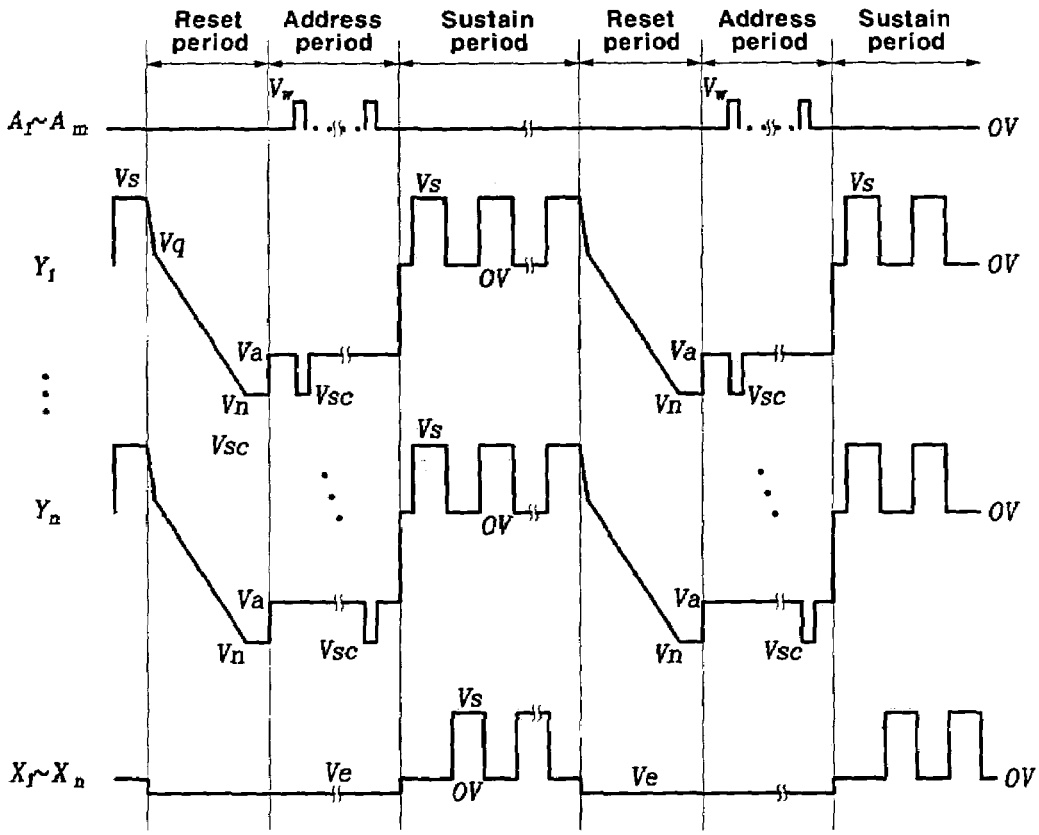

In FIG. 4, voltage $V_e$ applied to sustain electrodes $X_1$ to $X_n$ in the reset period and the address period is set to be a positive voltage. Voltage $V_e$ can be varied if a discharge can be generated between scan electrode $Y_j$ and sustain electrode $X_j$ by the discharge between scan electrode $Y_j$ and address electrode $A_i$ in the address period. For example, voltage $V_e$ can be 0V or a negative voltage as shown in FIGS. 6 and 7.

The voltage applied to the address electrode during the reset period has been described to be 0V in the above-described embodiments, and since to the wall voltage between the address electrode and the scan electrode is determined by the difference of the voltages applied to the address electrode and the scan electrode, the voltages applied to the address electrode and the scan electrode can be differently established when the difference of the voltages applied to the address electrode and the scan electrode satisfies the relations which correspond to the exemplary embodiments.

The ramp type voltages have been described to be applied to the scan electrode during the reset period in the embodiments, and in addition, other types of voltage for generating a weak discharge and controlling the wall chares can be applied to the scan electrode. Levels of the other types of voltages are gradually varied according to time variation.

As described, the problem of worsening the margins by loss of wall charges is removed since the addressing is not influenced by the wall charges formed in the reset period. The contrast ratio is enhanced since the amount of discharges in the reset period is reduced in the discharge cells which do not emit light. The maximum voltage applied to the PDP is reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel having a plurality of first electrodes and second electrodes in parallel on a first substrate, and a plurality of address electrodes crossing the first electrodes and the second electrodes on a second substrate, wherein a first electrode of the first electrodes, a second electrode of the second electrodes, and an address electrode of the address electrodes form a discharge cell of a plurality of discharge cells, the method comprising:

gradually reducing a voltage at the first electrode from a first voltage to a second voltage during a reset period;

applying a third voltage to the first electrode and applying a fourth voltage to the address electrode of the discharge cell to be selected from among the plurality of discharge cells, during an address period; and sustain discharging the discharge cell selected in the address period, during a sustain period, wherein the second voltage is less than a negative value of 80% of a difference between voltages applied to the first electrode for the sustain discharging in the sustain period.

2. The method of claim 1, wherein the second voltage is less than a negative value of a discharge firing voltage between the first electrode and the address electrode.

3. The method of claim 1, further comprising in the reset period reducing the voltage of the first electrode to the first voltage from a sustain voltage applied to the first electrode during the sustain period of a previous subfield.

4. The method of claim 1, wherein a voltage difference between the first electrodes and the address electrodes is reduced to the second voltage from the first voltage during the reset period of each subfield in at least one field.

5. The method of claim 2, wherein reducing the voltage at the first electrode to the second voltage fires a discharge in the discharge cell such that wall charges are eliminated in the discharge cell.

6. The method of claim 2, wherein a wall voltage between the first electrode and the address electrode is substantially eliminated during the reset period.

7. The method of claim 2, wherein the discharge firing voltage is a greatest one from among discharge firing voltages of the discharge cells in a valid display region.

8. The method of claim 2, wherein a difference between the third voltage and the fourth voltage is greater than the discharge firing voltage.

9. A plasma display comprising:

a first substrate;

a plurality of first electrodes and second electrodes in parallel on the first substrate;

a second substrate facing the first substrate with a gap therebetween;

a plurality of third electrodes crossing the first electrodes and the second electrodes on the second substrate; and a driving circuit for supplying driving voltages for discharging a plurality of discharge cells formed by the first, second and third electrodes, to the first, second and third electrodes, wherein the driving circuit gradually reduces a voltage at the first electrodes to a first voltage during a reset period, discharges a discharge cell to be selected from among the plurality of discharge cells during an address period, and sustain-discharges the selected discharge cell during a sustain period, and wherein the first voltage is less than a negative value of 80% of a difference between the driving voltages applied to the first electrodes for the sustain discharging in the sustain period.

10. The plasma display of claim 9, wherein the first voltage is less than a negative value of a discharge firing voltage between the first and third electrodes.

11. A method for driving a plasma display panel having a plurality of first electrodes and second electrodes in parallel on a first substrate, and a plurality of third electrodes crossing the first electrodes and the second electrodes on a second substrate, wherein a first electrode of the first electrodes, a second electrode of the second electrodes, and a third electrode of the third electrodes form a discharge cell of a plurality of discharge cells, wherein a field is divided into a plurality of subfields and is then driven, each subfield including a reset period, an address period, and a sustain period, the method comprising:

gradually reducing a voltage at the first electrode from a first voltage to a second voltage, during the reset period;

applying a third voltage to the first electrode and applying a fourth voltage to the third electrode of the discharge cell to be selected from among the plurality of discharge cells, during the address period; and sustain discharging the discharge cell selected in the address period by applying a sustain voltage during the sustain period, wherein in the reset period the voltage at the first electrode falls from the sustain voltage to the first voltage after the last pulse of the sustain period of a previous one of the subfields, wherein a difference in voltage between the second voltage and a voltage applied to the third electrode during the reset period is less than a negative value of 80% of a difference between voltages applied to the first electrode for the sustain discharging in the sustain period.

12. The method of claim 11, wherein no additional wall charges are formed in the discharge cell during the reset period.

13. The method of claim 11, wherein a voltage applied to the third electrode is 0V during the reset period.

14. A method for driving a plasma display panel having a plurality of first and second electrodes in parallel on a first substrate, and a plurality of address electrodes crossing the first electrodes and the second electrodes on a second substrate, wherein a first electrode of the first electrodes, a second electrode of the second electrodes, and an address electrode of the address electrodes form a discharge cell of a plurality of discharge cells, the method comprising:

sequentially applying a first voltage to the first electrodes, and applying a second voltage to the address electrode while the first voltage is applied to the first electrode of the discharge cell to be selected from among the plurality of discharge cells, wherein the first voltage is less than a negative value of 80% of a difference between voltages applied to the first electrodes for the sustain discharging in the sustain period.

15. The method of claim 14, further comprising gradually reducing a voltage at the first electrode to the first voltage during the reset period.

* * * * *